US006280066B1

(12) United States Patent
Dolan

(10) Patent No.: US 6,280,066 B1
(45) Date of Patent: Aug. 28, 2001

(54) LAMP DISPLAY SYSTEM

(76) Inventor: Patrick S. Dolan, 1020 SW. Westwood Ct., Portland, OR (US) 97201

( * ) Notice: Subject to any disclaimer, the term of this patent is extended or adjusted under 35 U.S.C. 154(b) by 0 days.

(21) Appl. No.: 09/437,287

(22) Filed: Nov. 10, 1999

(51) Int. Cl.[7] ..... F21S 8/08

(52) U.S. Cl. ..... 362/414; 362/410; 362/413; 362/418; 362/428; 248/371

(58) Field of Search ..... 362/414, 441, 362/410, 412, 413, 366, 270, 418, 427, 428; 248/371, 500, 510

(56) References Cited

U.S. PATENT DOCUMENTS 0,175,660 * 3/1876 Sankey ..... 362/410

5,019,753 * 5/1991 Strauss ..... 362/410

* cited by examiner

*Primary Examiner*—Sandra O'Shea
*Assistant Examiner*—Bertrand Zeade
(74) *Attorney, Agent, or Firm*—Robert L. Harrington

(57) ABSTRACT

A table lamp display system secures a lamp on a tilted shelf or block for display purposes. A coupler is attached to the stub end of a center tube of the lamp. A hollow tube extension of suitable length is inserted through a slot of the shelf or block and is secured to the coupling to secure the lamp to the shelf or block. In another arrangement the lamp is secured to a configured hook that is attached to the shelf.

14 Claims, 4 Drawing Sheets

LAMP DISPLAY SYSTEM

FIELD OF THE INVENTION

This invention relates to the display of lamps in large retail outlets and more particularly to the securement of such lamps on overhead tilted shelves for optimum display of the lamps.

BACKGROUND OF THE INVENTION

Lamps such as floor lamps and table lamps are commonly purchased for decorative as well as lighting purposes. There are thousands of different lamp designs that are available to a purchaser. A purchaser understands that different lamps will satisfy his or her lighting requirements and it is the decorative appeal that determines selection.

A table lamp is typically placed on a table of some sort and often a wood table. The table places the lamp at a height that is about at eye level when seated but is quite visible from a standing position. Such is also true for floor lamps. The purchaser wants to examine the lamp design as visualized for example on such a table when making his purchase.

Large retail stores or outlets in particular want to maximize the use of display space and overhead shelving is common for displaying items such as lamps. The overhead shelving also places the display out of the reach of customers and avoids the disruption that occurs from customer handling. To enable purchasers to ideally examine merchandise displayed on overhead shelves, the shelves may be tilted. Such is not feasible for table lamps or floor lamps as such lamps are top heavy and tilting of the shelf can result in tipping the lamp off the shelf. Thus, lamps when displayed on overhead shelving are commonly displayed on non-tilted shelves and such is unsatisfactory for examining the lamp's decorative appeal.

BRIEF DESCRIPTION OF THE INVENTION

The provision of visually exposed brackets to secure a lamp to a tilting shelf is generally not considered satisfactory. In the preferred embodiment of the invention, the structure of the lamp itself is utilized for securement to a tilted shelf. Almost all lamps are structured to have a decorative body portion with a socket provided at the top (over which a lamp shade is mounted) and a base portion at the bottom either as part of the body or as a separate component. A tube extends from the base through the body to the socket and it performs a dual function. The tube is threaded at the top and bottom. It is secured at its top to the socket, inserted down through the body and base and then a nut is threaded onto the bottom of the tube to secure the base (if separate), body and socket together. The tube also functions as a conduit for extending an electrical cord from the base to the socket. The cord often projects from within the base out through a hole in the base, the projecting cord end being fitted with an electrical plug that can be connected to an electrical outlet. The bottom of the base is often covered with a felt or similar covering to avoid scratching a table top.

Once the nut is threaded onto the bottom end of the tube, only a short stub of the tube end is exposed. However, it is the stub end of the tube that provides for the mounting of the lamp. The felt cover is removed and the plug is removed from the cord end (e.g., as by cutting). The cord is pulled back into the base and inserted through a coupler and a tube extension (the combination referred to as a coupling). The coupler is provided with female threads to fit the threads of the stub shaft and the tube extension is then threadably secured to the other end of the coupler. A tilted shelf is provided with a hole that receives the tube extension. The inserted end of the tube extension is then fitted with a fastener, e.g., a nut, that threadably fits the end of the extension. The cord end is inserted down through the coupler, tube extension and nut and fitted with a plug and connected to an electrical outlet under the shelf. A viewer is able to examine the lamp from a side view even though the lamp is sitting on an overhead but tilted shelf and without the distractions of brackets or the like. It will be understood that the under side of the shelf can be covered as desired.

The invention will be more fully understood and appreciated upon reference to the following detailed description having reference to the accompanying drawings.

DESCRIPTION OF THE PREFERRED EMBODIMENT

Figure 1:
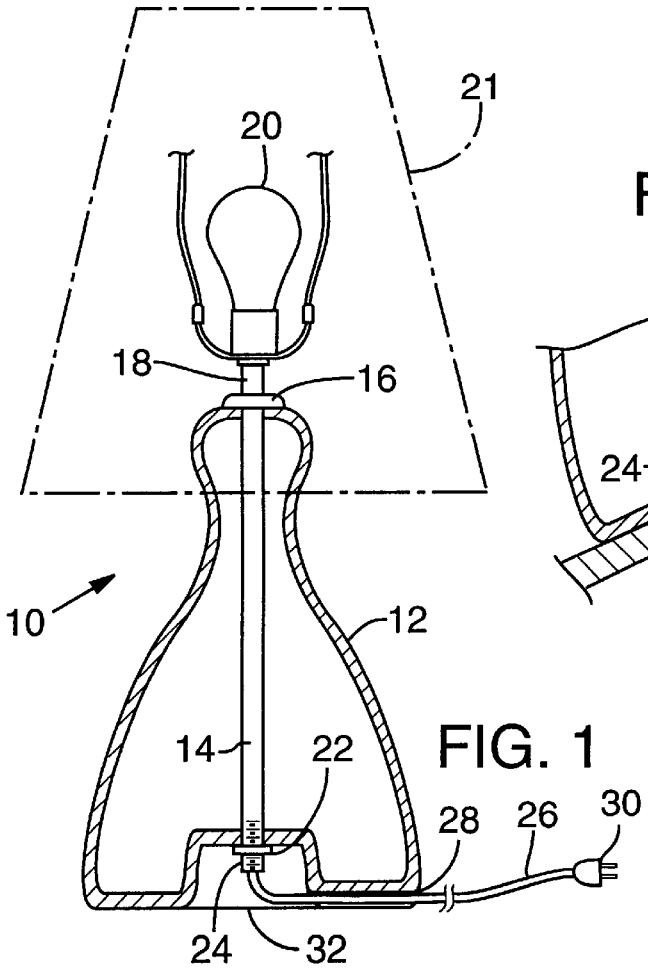
FIG. 1 is a view of a lamp assembly.

FIG. 1 illustrates a typical lamp assembly 10. The lamp assembly 10 has a body portion 12, that is most often of an artistic or appealing shape. A threaded tube 14 is installed in the body portion 12 and is secured by a nut 16. Mounted on the threaded tube 14 at the top of the body portion 12 is a lamp socket assembly 18. The lamp socket assembly 18 receives a bulb 20 and also provides support for a shade 21. The threaded tube 14 is secured at the lower end of the body portion 12 (the base portion) by another nut 22. A stub end 24 of the tube 14 extends beyond the nut 22. An electrical wire 26 is extended from the lamp socket 18 down through the tube 14 and extends through an aperture 28 in the base portion of the body portion 12. The electrical wire 26 has a standard plug 30 which is insertable into a standard outlet to supply power to the lamp assembly 10. Typically a pad 32, such as felt, is attached to the bottom of the body portion 12 to protect the surface upon which the lamp assembly 10 will be placed. The above describes a typical lamp assembly 10, however it will be appreciated that there are many variations in design and configuration.

The object of the present invention is to provide means for mounting the lamp assembly 10 on a tilted display shelf without the possibility of the lamp being subject to tipping or toppling off the shelf. In the preferred embodiment, the structure of the lamp assembly 10 is utilized to provide a secure mount of the lamp assembly 10 to a tilted shelf.

Figure 3:
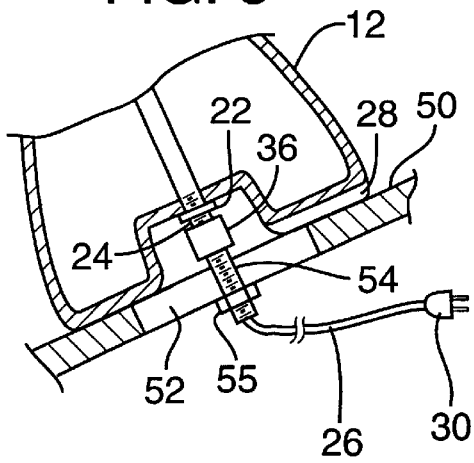
FIG. 3 is a sectional view showing the lamp assembly of FIG. 1 mounted to a tilted shelf.
Figure 2:
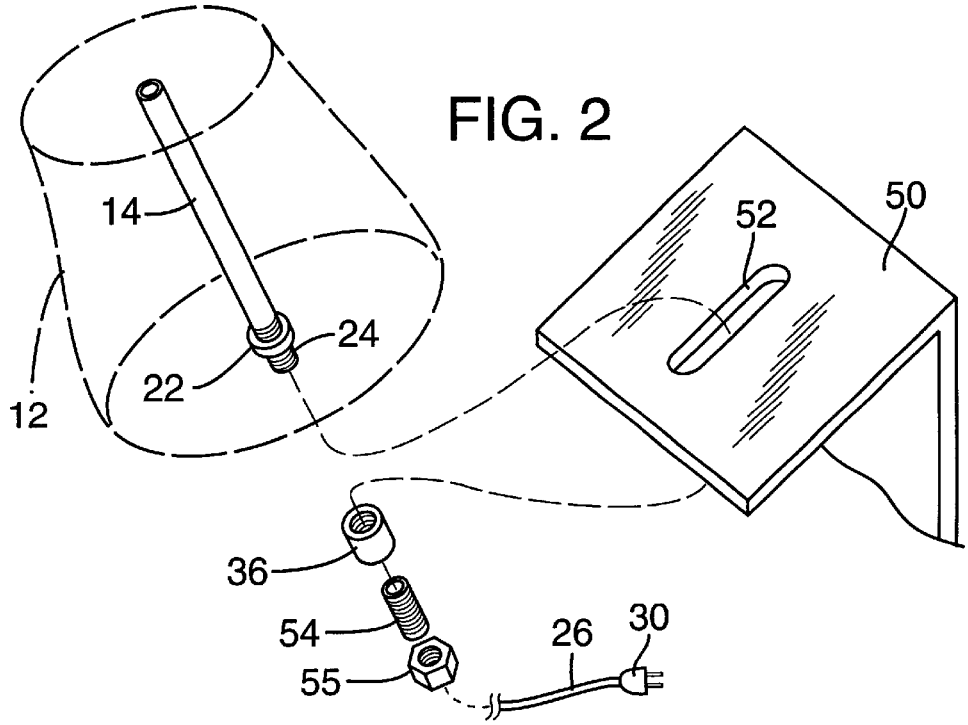
FIG. 2 is a partial exploded view of the lamp assembly of FIG. 1 and a portion of a tilting shelf.

The lamp assembly 10 is secured to a tilted shelf 50 as shown in FIGS. 2 and 3. The plug 30 is cut off from the wire 26. The pad 32 is removed from the base of the body portion 12 to expose the stub end 24 of the tube 14. The wire 26 is withdrawn through the aperture 28 and the wire 26 extends from the end of the tube 14. A coupler 36 is slid over the wire 26 and is threadably installed on the stub end 24 of the tube 14. An extension tube 54 is slid over the wire 26 and is threadably installed in the coupler 36.

Figure 4:
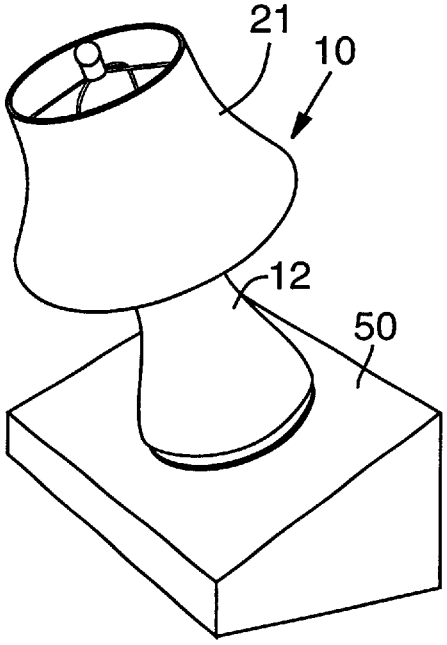
FIG. 4 is another view of the lamp assembly of FIG. 1 mounted to a shelf.

FIGS. 3 and 4 illustrate the lamp assembly 10 mounted on a tilted shelf 50. The shelf 50 has a slot opening 52 that is aligned with and receives the extension tube 54. The tube 54 is of sufficient length to extend through the thickness of the shelf 50.

A nut 55 is mounted on the tube 54 to secure the lamp 10 to the shelf 50 in a tilted position. A new plug 30 is installed on the end of the extending wire 26.

Figure 5:
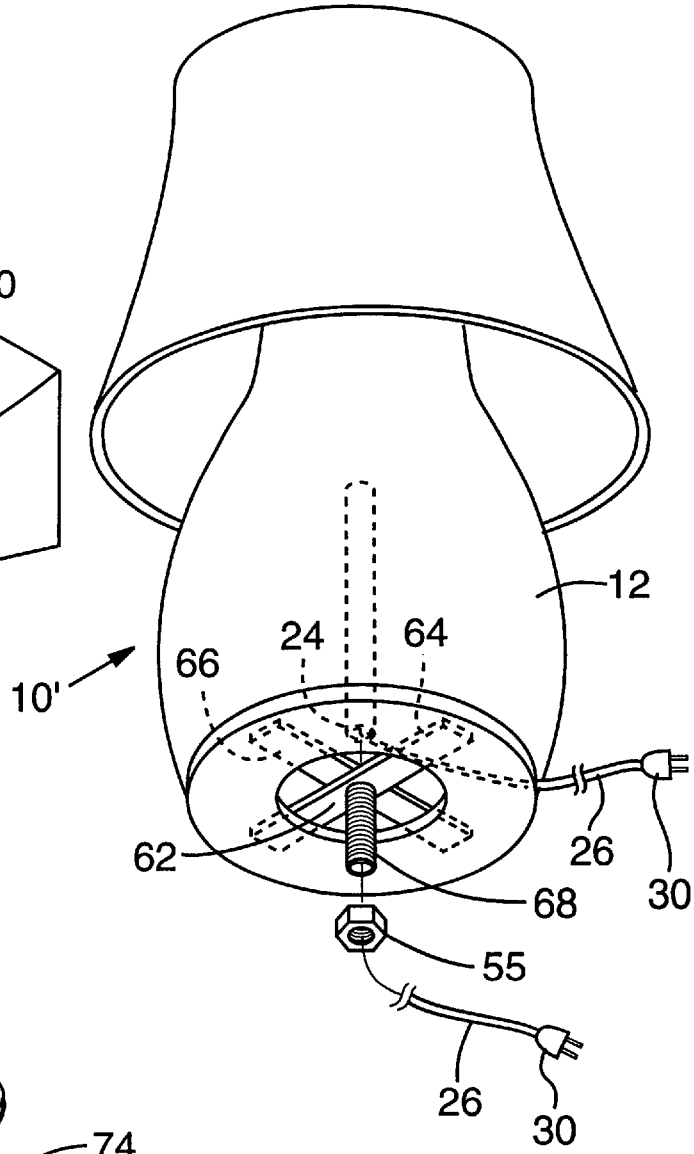
FIG. 5 is a view illustrating another mounting arrangement for a lamp.

FIG. 5 illustrates another manner of mounting a lamp 10' on a shelf 50. In this embodiment the body 12 of the lamp 10 has an enlarged opening 60 in its base. The wire 26 extends from the socket down through the body 12 loosely as illustrated. A cross member 62 is insertable into the opening 60 and will engage the edges of the opening 60. The cross member 62 has two legs 64, 66 that are threadably installed on a tube member 68 that extends below the base. The legs 64, 66 are rotated on the tube member 68 so that they overlap one another permitting the cross member to be inserted into the base of the lamp. When inserted in the base of the lamp, the legs 64, 66 are rotated so that they are normal to each other. The lamp 10' is installed on the shelf 50 with the tube 68 extending through the shelf 50 and is secured by the nut 55 to retain the lamp 10' on the shelf 50. With this arrangement the wire 26 does not have to be removed from its normal position, or if preferred it can be threaded down through tube member 68 as also shown.

There are occasions where a lamp is displayed on a horizontal shelf but it is desired to tilt the lamp for display purposes. A mounting block 70 shown in FIG. 6 has an inclined surface 72 at the desired display angle. A slot 74 is provided in the surface 72 to facilitate mounting the lamp 10 to the mounting block 70 in the same manner as the lamp 10 is mounted to the shelf 50 as shown in FIGS. 3 and 4. The mounting block 70 is then placed on a horizontal shelf 76 at a desired position.

Figure 7:
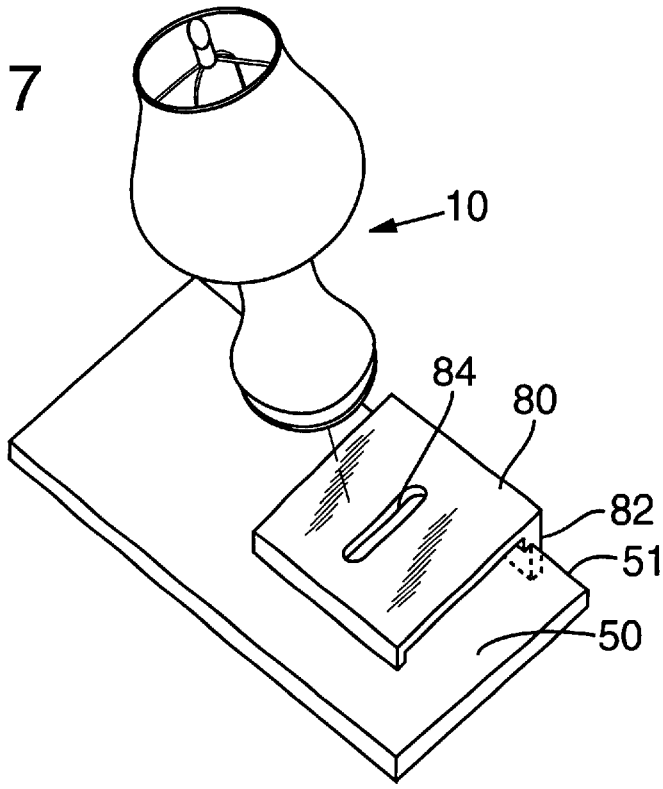
FIG. 7 is a view of a mounting bracket for mounting a lamp to a tilted shelf.

Another arrangement for mounting a lamp 10 in tilted attitude is the use of a mounting brace 80 shown in FIG. 7 that is mountable at any position on the tilted shelf 50. The brace 80 has an extending lip 82 that engages the edge 51 of the shelf 50 to secure the brace 80 to the shelf 50. The brace 80 has a slot 84 to facilitate mounting the lamp 10 to the brace 80 in the same manner as shown in FIGS. 3 and 4. The reader will appreciate that whereas the openings shown are in the form of slots, the openings can be any configuration (round, square, etc.) Which will receive the bracket and provide attachment thereof to the support surface.

Figure 8:
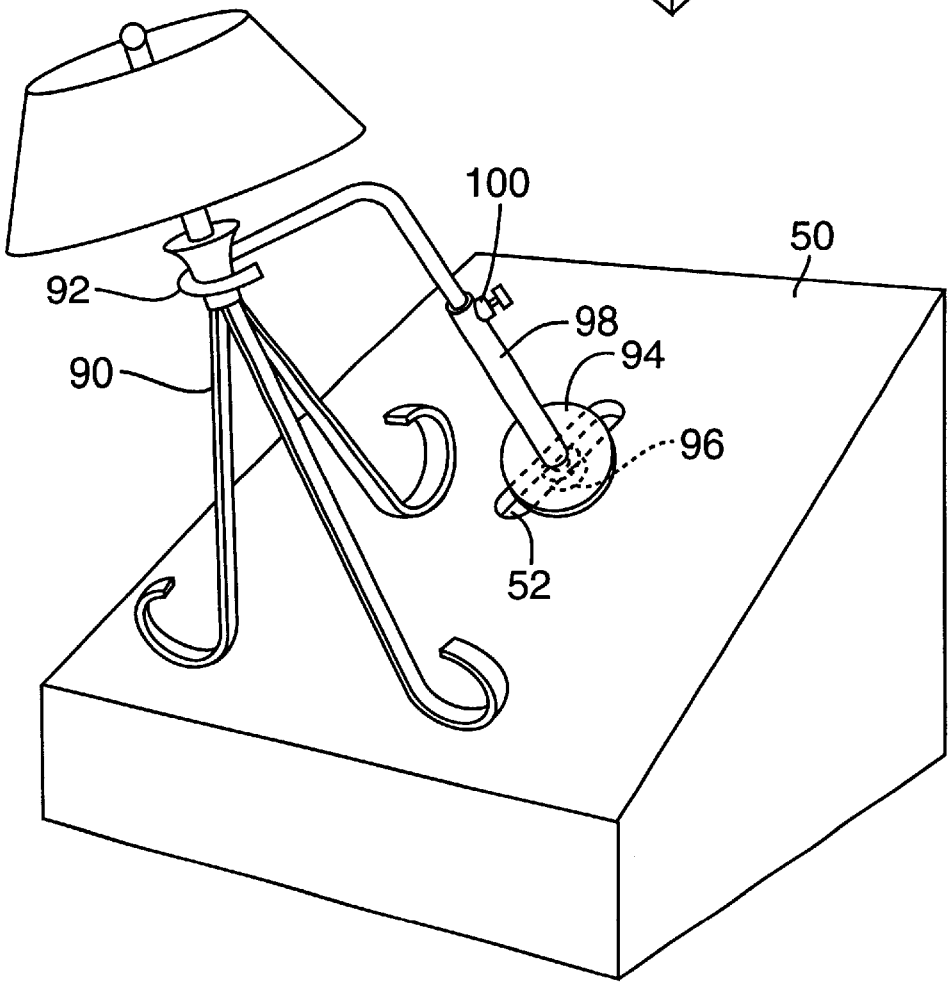
FIG. 8 is a view of another mounting arrangement for mounting the lamp in a tilted attitude.

Some lamps have different configurations and don't lend themselves to be mounted in the manner described. A lamp 90, for example as shown in FIG. 8, is of the type that does not have a center tube 14 extending from the socket assembly 18. To secure the lamp 90 to a tilted shelf 50 (or mounting brace 80) a hook 92 is mounted in the slot 52 of the shelf 50. The hook 92 has a top flange 94 that engages the top surface of the shelf 50 and is secured by a nut 96. The hook is adapted to encircle the top of the lamp 90 to secure the lamp in the tilted position. The hook 92 is adjustably mounted in a tube 98 that extends from the flange 94. The hook 92 is held in position by a lock mechanism 100.

Figure 6:
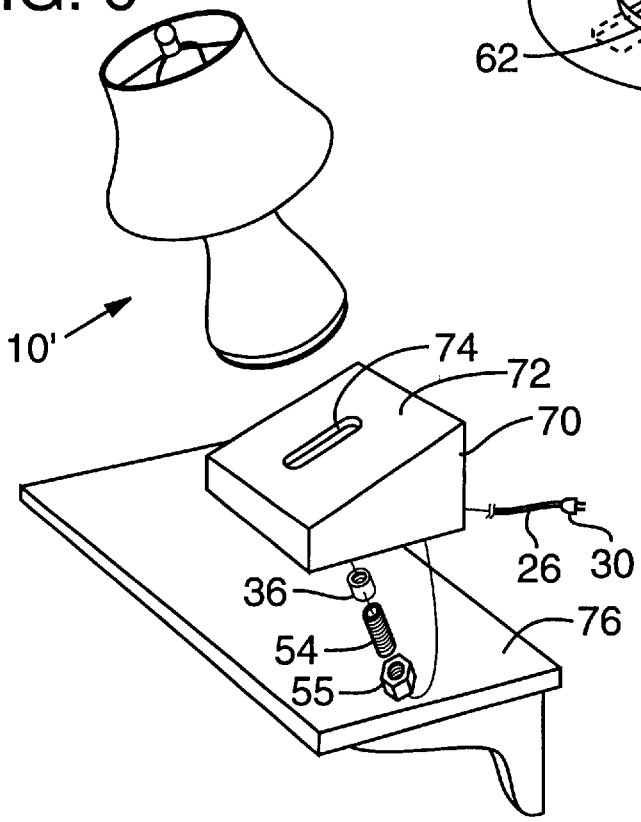
FIG. 6 is a view of a mounting block for mounting a lamp in a tilted attitude on a horizontal shelf.
Figure 9:
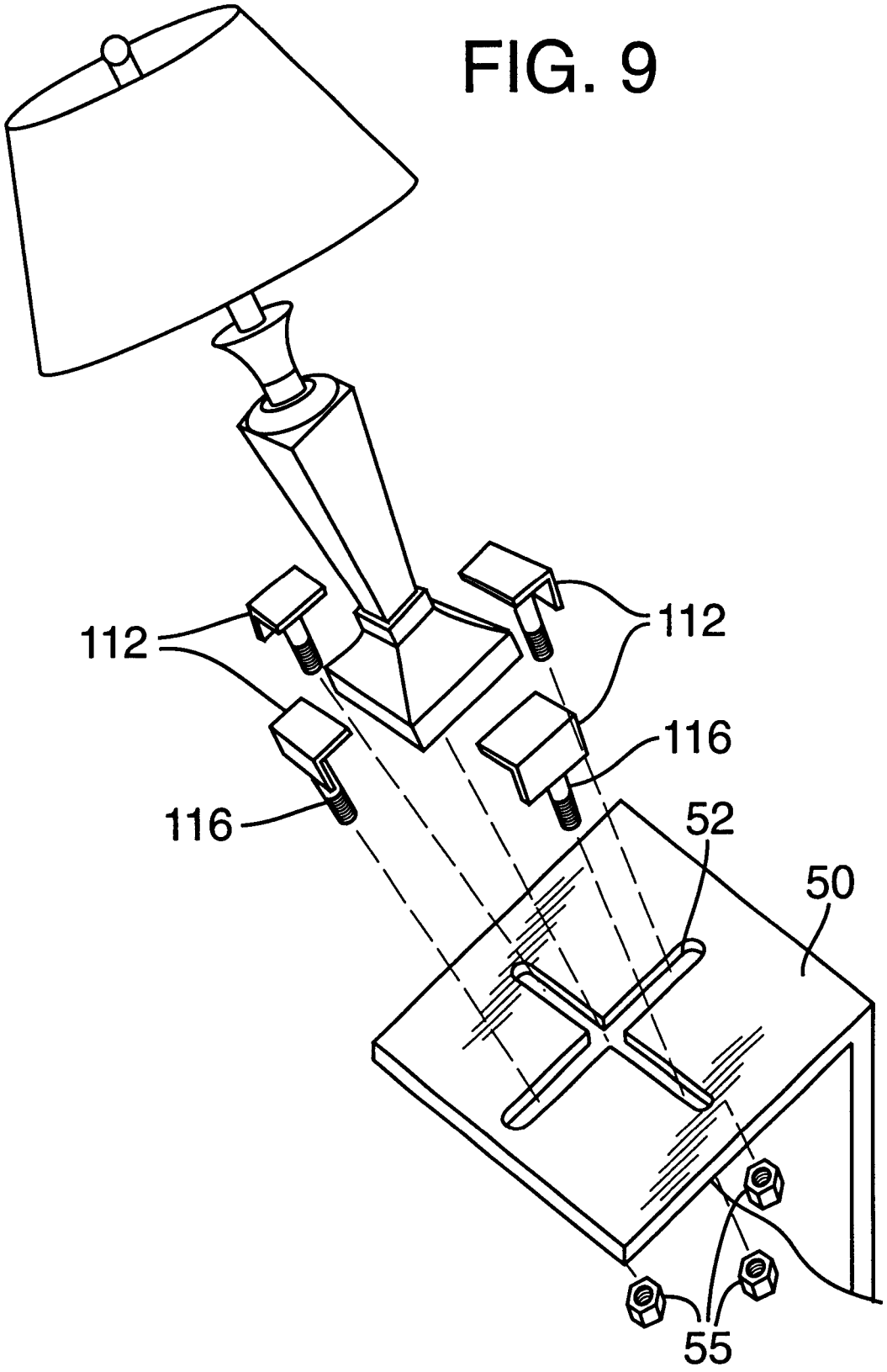
FIG. 9 is a view of another mounting arrangement for mounting the lamp in a tilted attitude.

FIG. 9 illustrates another example of securing a lamp 110 to the tilted shelf 50. Brackets 112 configured to engage the base 114 of the lamp 110 are fitted in the slot 52 of the shelf 50. The brackets 112 have a threaded stud 116 that extends through the slot 52. A nut 55 is fitted on the stud 116 to secure the lamp 110 to the shelf 50. It will be appreciated that the brackets 112 may be used with the block 70 as shown in FIG. 6 to secure the lamp 110 to the block 70.

The different embodiments shown are but a few of the ways that a lamp can be secured to a tilted shelf. Other means for achieving such securement can include for example an anchor screwed into the shelf or wall behind the shelf and a thin wire extended from the lamp near or at the socket and secured to the anchor. The lamp base may be receptive to the use of an adhesive and glued to the shelf. Velcro type fasteners may be applied and so on. Preferably the means used for securement is substantially not visible so that a customer can visualize the total design and only the design of the lamp.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. An elevated lamp display comprising:

a tilted surface provided at an elevated position in a retail outlet display area;

a lamp including a socket connected to a body portion having a base, the base supported on said tilted surface; and a securement member securing said lamp to the tilted surface to prevent tipping of the lamp off the surface.

2. A lamp display as defined in claim 1 wherein:

the tilted surface is an overhead display shelf having a top and a bottom and said lamp is a table lamp; and said securement member for securing said lamp is attached to said lamp and attached to said shelf.

3. A lamp display as defined in claim 2 wherein said securement member is a bracket that attaches to the shelf and is coupled to the lamp.

4. A lamp display as defined in claim 1 wherein the securement member is substantially non visual to a viewer viewing the display.

5. A lamp display as defined in claim 1 wherein the securement device is a bracket attached to the lamp and secures the lamp in place on the tilted surface.

6. A lamp display as defined in claim 5 wherein the bracket is attached to the lamp and the tilted surface to secure the lamp to the surface.

7. A lamp display as defined in claim 3 wherein the lamp includes a body portion having a top and a bottom, a socket provided at the top and a base provided at the bottom, a tube extended from the socket to the base and extended through the base, an opening through the shelf and the tube extended down through the opening in the shelf, an end of the tube being externally threaded and extended through the bottom of the shelf and a nut threadably engaging the threaded end and securing the tube and thereby the lamp at the bottom of the shelf.

8. A lamp display as defined in claim 7 wherein an electrical wire is extended from the socket through the tube and out of the tube end at the bottom of the shelf.

9. A lamp display as defined in claim 7 wherein a first tube length extends into the base of the lamp, a coupler is secured to the first tube length and a second tube length is coupled to the coupler and extended through the shelf opening.

10. A method of displaying table lamps in a retail outlet wherein the table lamp has a body portion with opposed ends, a socket portion at one end, and a base portion at the other end and a tube extended from the socket portion through the body portion and terminating at a threaded end in the base portion, said base portion having a hollow interior and the tube extended into the interior with a nut threaded onto the threaded end, and an electrical wire extended from the socket portion through the tube and out of the base portion whereat an end of the electrical wire is fitted with a plug and said table lamp as situated on a residential table in a residential room defining a viewing angle for a person in the room: said method comprising:

exposing the interior of the base portion;

removing the plug from the end of the electrical wire;

inserting the electrical wire through a threaded coupling and threadably attaching the coupling to the tube portion protruded past the nut, providing an overhead shelf substantially greater in height than the residential table whereby objects on the shelf are viewed at an upwardly directed angle, tilting the shelf downwardly to compensate for the difference in said viewing angle for a person in the room and the upwardly directed angle of the overhead shelf, providing an opening through the shelf sized to receive said coupling, and inserting the coupling through the opening and securing the coupling to the bottom of the shelf and thereby the table lamp to the shelf to thereby simulate the viewing angle for a person viewing the lamp in a residential room without visual notice of the manner of securing the lamp to the shelf.

11. A method as defined in claim 10 wherein the coupling includes a coupler and a tube extension, said coupler having interior threads mated to the threads of the tube and said tube extension having mated exterior threads for insertion into the coupling, said method further comprising:

threadably securing the coupler onto the tube and the tube extension onto the coupler, inserting the tube extension through the opening and threadably applying a nut onto the tube extension under the shelf.

12. An elevated lamp display comprising:

a table lamp designed to be supported on a horizontal surface of a table which in turn is supported on a floor of a residential room and as supported on such a table defining an angle of visual appearance to a person standing in said residential room;

a lamp display surface provided at an elevated position above a floor in a retail outlet display area which elevated position is substantially greater in height than the table height above said floor of said residential room thereby requiring a shopper to view the table lamp at an upwardly directed viewing angle;

said surface tilted toward the shopper to compensate for the upwardly directed viewing angle and thereby to simulate said visual appearance; and a securement device securing said lamp to said tilted surface to prevent tipping of the lamp off the tilted surface.

13. An elevated lamp display as defined in claim 12 wherein the securement device is non visual to a shopper viewing the lamp display.

14. An elevated lamp display as defined in claim 13 wherein the table lamp includes a base having a bottom surface engaging the lamp display surface and the securement device extending from the bottom surface of the base through the shelf for attachment to an underside of the shelf.

* * * * *